US009850024B2

(12) United States Patent
Ojima et al.

(10) Patent No.: US 9,850,024 B2
(45) Date of Patent: Dec. 26, 2017

(54) CAN LID AND BEVERAGE CAN

(71) Applicant: SHOWA ALUMINUM CAN CORPORATION, Tokyo (JP)

(72) Inventors: Shinichi Ojima, Tokyo (JP); Kazunori Ikeda, Tokyo (JP); Tetsuo Kashiwazaki, Tokyo (JP); Asumi Suwa, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 260 days.

(21) Appl. No.: 14/434,205

(22) PCT Filed: Oct. 17, 2013

(86) PCT No.: PCT/JP2013/078196

§ 371 (c)(1),
(2) Date: Apr. 8, 2015

(87) PCT Pub. No.: WO2014/073350

PCT Pub. Date: May 15, 2014

(65) Prior Publication Data

US 2015/0259094 A1 Sep. 17, 2015

(30) Foreign Application Priority Data

Nov. 7, 2012 (JP) ..... 2012-245444

(51) Int. Cl.
*B65D 17/00* (2006.01)
*B65D 1/16* (2006.01)
*B65D 85/72* (2006.01)

(52) U.S. Cl.
CPC ..... *B65D 17/165* (2013.01); *B65D 1/165* (2013.01); *B65D 17/24* (2013.01); *B65D 85/72* (2013.01);
(Continued)

(58) Field of Classification Search
CPC ..... B65D 17/165; B65D 17/16; B65D 17/24; B65D 17/02; B65D 17/163; B65D 2517/0014; B65D 2517/0016
(Continued)

(56) References Cited

U.S. PATENT DOCUMENTS 3,343,714 A * 9/1967 Cardani ..... B21D 51/383 220/273
3,501,046 A * 3/1970 Robertson ..... B65D 17/163 220/273
(Continued)

FOREIGN PATENT DOCUMENTS

CN 1246098 A 3/2000
CN 2795059 Y 7/2006
(Continued)

OTHER PUBLICATIONS

Extended European Search Report dated May 6, 2016 issued for corresponding European Patent Application No. 13852872.4.
(Continued)

*Primary Examiner* — Robert Poon
(74) *Attorney, Agent, or Firm* — Sughrue Mion, PLLC

(57) ABSTRACT

A tab main body section (520) is provided with first to third main body section slits (731-733) which penetrate through the tab main body section (520). The first to third main body section slits (731-733) are formed in a circular arc shape so as to extend along the outer peripheral edge of an insertion hole (540) formed in a circular shape. The first main body section slit (731) is provided between the insertion opening (540) and a first edge section (501) of a tab (500). The second main body section slit (732) and the third main body section slit (733) each have one end section (751) and the
(Continued)

other end section (752). The one end section (751) is located closer to a second edge section (502) of the tab (500) than the insertion hole (540).

6 Claims, 10 Drawing Sheets

(52) U.S. Cl.
CPC ..... *B65D 2517/002* (2013.01); *B65D 2517/0014* (2013.01)

(58) Field of Classification Search
USPC ..... 220/269–270
See application file for complete search history.

(56) References Cited

U.S. PATENT DOCUMENTS

| | | | | |
|---|---|---|---|---|
| 3,712,503 | A * | 1/1973 | Zundel | B65D 17/163 220/273 |
| 3,967,752 | A | 7/1976 | Cudzik | |
| 4,132,328 | A * | 1/1979 | Zundel | B65D 17/24 220/267 |
| 4,394,927 | A * | 7/1983 | Zysset | B65D 17/163 220/273 |
| 5,494,184 | A | 2/1996 | Noguchi et al. | |
| 5,799,816 | A * | 9/1998 | Schubert | B65D 17/16 220/269 |
| 6,050,440 | A * | 4/2000 | McEldowney | B65D 17/165 220/269 |
| 2008/0099480 | A1 | 5/2008 | Chang | |
| 2010/0032433 | A1 | 2/2010 | Kobayashi | |
| 2010/0166528 | A1 | 7/2010 | McEldowney et al. | |

FOREIGN PATENT DOCUMENTS

| | | | |
|---|---|---|---|
| CN | 101128361 | A | 2/2008 |
| JP | 51-82188 | A | 7/1976 |
| JP | 2002-513367 | A | 5/2002 |
| JP | 3468548 | B2 | 11/2003 |
| JP | 2012-35859 | A | 2/2012 |
| JP | 2012-106755 | A | 6/2012 |
| WO | 2005/000694 | A1 | 1/2005 |
| WO | 2009/142386 | A2 | 11/2009 |

OTHER PUBLICATIONS

International Search Report for PCT/JP2013/078196 dated Dec. 3, 2013.

* cited by examiner

CAN LID AND BEVERAGE CAN

CROSS REFERENCE TO RELATED APPLICATIONS

This application is a National Stage of International Application No. PCT/JP2013/078196 filed Oct. 17, 2013, claiming priority based on Japanese Patent Application No. 2012-245444 filed Nov. 7, 2012, the contents of all of which are incorporated herein by reference in their entirety.

TECHNICAL FIELD

The present invention relates to a can lid and a beverage can.

BACKGROUND ART

A beverage can in which breakage of a panel is caused at a score line by a press of part of the panel by a tab to thereby form an opening that functions as a place a person drinks from is suggested (for example, refer to Patent Document 1).

CITATION LIST

Patent Literature

Patent Document 1: Japanese Patent Application Laid-Open Publication No. 51-82188

SUMMARY OF INVENTION

Technical Problem

A beverage can in which breakage of a panel is caused at a score line by a press of part of the panel by a tab to thereby form an opening that functions as a place a person drinks from is known. Here, in such a beverage can, by further operating the tab after the breakage of the panel is caused, a tongue-shaped broken section produced by the breakage of the panel is pressed into the inside of the beverage can, and thereby the opening is formed.

An object of the present invention is to provide a can lid or the like that is capable of smoothly breaking a panel and smoothly pressing a broken section, which is produced by breakage of the panel, by a tab.

Solution to Problem

A can lid, to which the present invention is applied, includes: a panel that includes an outer peripheral edge and is attached to an aperture of a can barrel; a tab that includes a first edge section, a second edge section on a side opposite to the first edge section, a first side edge formed to head for the second edge section from the first edge section, and a second side edge formed to head for the second edge section from the first edge section and arranged on a side opposite to the first side edge, the tab being operated by a user, when an opening is formed in the panel, to move in a direction in which the first edge section side is apart from the panel; and a connecting section that connects a portion of the tab positioned between the first edge section and the second edge section and the panel, wherein the tab is provided with: a first through hole that is provided between the first edge section and the connecting section; a second through hole that is formed to include one end section closer to a side, on which the second edge section is provided, than the connecting section, and is formed to pass between the connecting section and the first side edge and also between the first through hole and the first side edge to head for the first edge section side from a location where the one end section is positioned, the second through hole being formed so that at least a part thereof heads for the second side edge side and the other end section is located in a region positioned between the first through hole and the first edge section; and a third through hole that is formed to include one end section closer to a side, on which the second edge section is provided, than the connecting section, and is formed to pass between the connecting section and the second side edge and also between the first through hole and the second side edge to head for the first edge section side from a location where the one end section is positioned, the third through hole being formed so that at least a part thereof heads for the first side edge side and the other end section is positioned in the region located between the first through hole and the first edge section.

Here, the connecting section connects a portion positioned on a center line of the tab and the panel, the portion being positioned on the center line heading for the second edge section side from the first edge section side, the first through hole is provided on the center line of the tab, and formed into a linear symmetrical shape with respect to the center line as a symmetrical axis, and one through hole of the second through hole and the third through hole is formed in one of two regions facing with the center line interposed therebetween, and the other through hole is formed on the other of the two regions, the second through hole and the third through hole being arranged in a linear symmetrical relation with respect to the center line as a symmetrical axis. In this case, it becomes possible to suppress unstable behavior of the tab.

Moreover, the first through hole is formed to draw a circular arc around a location where the connecting section is provided. In this case, it is possible to make concentration of stress that possibly occurs in the tab less likely to be caused, as compared to a case in which the first through hole is formed to be bent.

Moreover, the second through hole and the third through hole are formed to draw circular arcs around the location where the connecting section is provided. In this case, it is possible to make concentration of stress that possibly occurs in the tab less likely to be caused, as compared to a case in which the second through hole and the third through hole are formed to be bent.

Moreover, the second through hole and the third through hole, which are formed to draw the circular arcs, are provided to pass through a location which is separated from the connecting section by a first separation distance, and are formed so that the first separation distance is larger than a separation distance between the first through hole and the connecting section, the second through hole and the third through hole extending to the region positioned between the first through hole and the first edge section. In this case, as compared to a case in which the second through hole and the third through hole do not extend to the region positioned between the first through hole and the first edge section of the tab, it becomes possible to reduce a load, which is applied to a portion of the connecting section positioned on the first edge section side and is applied when operation of the tab is started by the user.

Moreover, in a case where the present invention is captured as a beverage can, a beverage can, to which the present invention is applied, includes: a can barrel that includes an aperture and contains a beverage inside thereof; and a can lid with which the aperture of the can barrel is covered, wherein the can lid includes: a panel that includes an outer peripheral edge and is attached to the aperture of the can barrel; a tab that includes a first edge section, a second edge section on a side opposite to the first edge section, a first side edge formed to head for the second edge section from the first edge section, and a second side edge formed to head for the second edge section from the first edge section and arranged on a side opposite to the first side edge, the tab being operated by a user, when an opening is formed in the panel, to move in a direction in which the first edge section side is apart from the panel; and a connecting section that connects a portion of the tab positioned between the first edge section and the second edge section and the panel, wherein the tab is provided with: a first through hole that is provided between the first edge section and the connecting section; a second through hole that is formed to include one end section closer to a side, on which the second edge section is provided, than the connecting section, and is formed to pass between the connecting section and the first side edge and also between the first through hole and the first side edge to head for the first edge section side from a location where the one end section is positioned, the second through hole being formed so that at least a part thereof heads for the second side edge side and the other end section is located in a region positioned between the first through hole and the first edge section; and a third through hole that is formed to include one end section closer to a side, on which the second edge section is provided, than the connecting section, and is formed to pass between the connecting section and the second side edge and also between the first through hole and the second side edge to head for the first edge section side from a location where the one end section is positioned, the third through hole being formed so that at least a part thereof heads for the first side edge side and the other end section is positioned in the region located between the first through hole and the first edge section.

Advantageous Effects of Invention

According to the present invention, it is possible to provide a can lid or the like that is capable of smoothly breaking a panel and smoothly pressing a broken section, which is produced by breakage of the panel, by a tab.

DESCRIPTION OF EMBODIMENTS

Hereinafter, an exemplary embodiment according to the present invention will be described in detail with reference to attached drawings.

Figure 1:
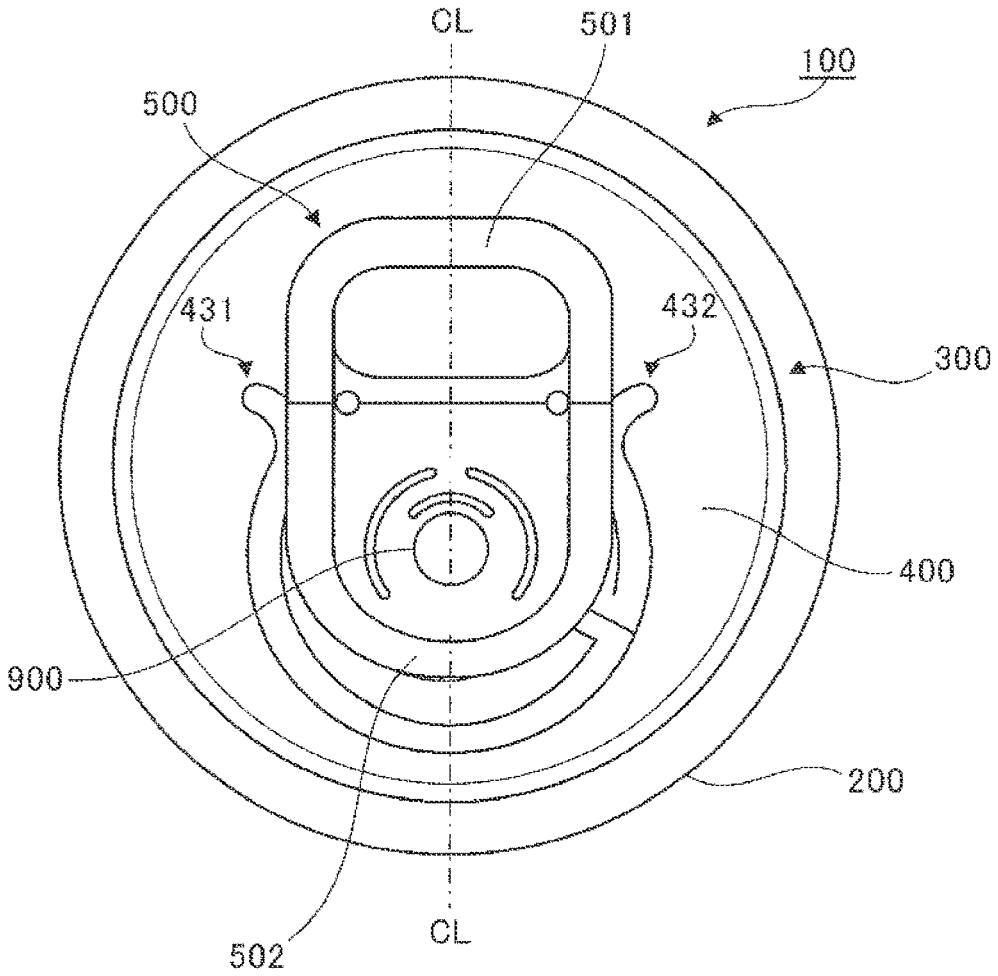
FIG. 1 is a top view of a beverage can to which an exemplary embodiment is applied.

FIG. 1 is a top view of a beverage can 100 to which the exemplary embodiment is applied. As shown in the figure, the beverage can 100 includes a container body (can barrel) 200 that is formed in a cylindrical shape and has an aperture at an upper portion and a bottom section at a lower portion, and a can lid 300 that is attached to the aperture of the container body 200 to cover the aperture of the container body 200. It should be noted that the beverage can 100 is filled with (contains) a drink (contents), such as a soft drink, a carbonated drink or an alcoholic beverage.

The can lid 300 includes a panel 400 that is formed into a disk shape and functions as a substrate. Moreover, the can lid 300 includes a tab 500 to be operated by a user. Here, the tab 500 is attached to the panel 400. In addition, the tab 500 is arranged along one direction from a peripheral edge section side of the panel 400 toward a rivet 900.

Moreover, the tab 500 includes a first edge section 501 on one end section side in the longitudinal direction thereof and a second edge section 502 on the other end section side in the longitudinal direction, and, by user's operation such that the first edge section 501 side is moved in a direction away from the panel 400, the second edge section 502 is pressed against a predetermined location of the panel 400 (to be described in detail later), to thereby press the panel 400. It should be noted that the can lid 300 in the exemplary embodiment is a can lid of a so-called stay-on type, in which the tab 500 maintains a state of being attached to the panel 400 even after the opening that functions as a place a person drinks from is formed on the panel 400.

Here, in the exemplary embodiment, the tab 500 is fastened to the panel 400 by the rivet 900 provided at a position deviated from a center section (center) of the panel 400. To additionally describe, the tab 500 is fastened to the panel 400 by the rivet 900 provided in a decentered state with respect to the panel 400. To describe further, the tab 500 is fastened to the panel 400 by the rivet 900 provided closer to the center section of the panel 400 than the location of the panel 400 pressed by the tab 500.

Further, in the tab 500, a portion positioned between the first edge section 501 and the second edge section 502 of the tab 500 is fastened to the panel 400 by the rivet 900. Here, the location where the rivet 900 is provided is able to be grasped as a connecting section that connects the portion positioned between the first edge section 501 and the second edge section 502 of the tab 500 and the panel 400. Moreover, the rivet 900 connects a portion positioned on a center line CL of the tab 500 (a virtual center line CL extending from the first edge section 501 side toward the second edge section 502 side along the longitudinal direction of the tab 500) and the panel 400.

Here, in the exemplary embodiment, description is given by taking a mode in which the tab 500 is fastened to the panel 400 by the rivet 900 provided at the position deviated from the center section of the panel 400 as an example; however, the tab 500 may be fastened to the panel 400 by a rivet 900 provided at the center section of the panel 400. Moreover, in FIG. 1, the tab 500 in which the second edge section 502 (a tip end section of the tab 500 (a tab nose)) was formed in a circular arc shape was exemplified; however, for example, it may be possible that the tab 500 is formed in a rectangular shape and the tip end section of the tab 500 is formed in a linear fashion.

Figure 2:
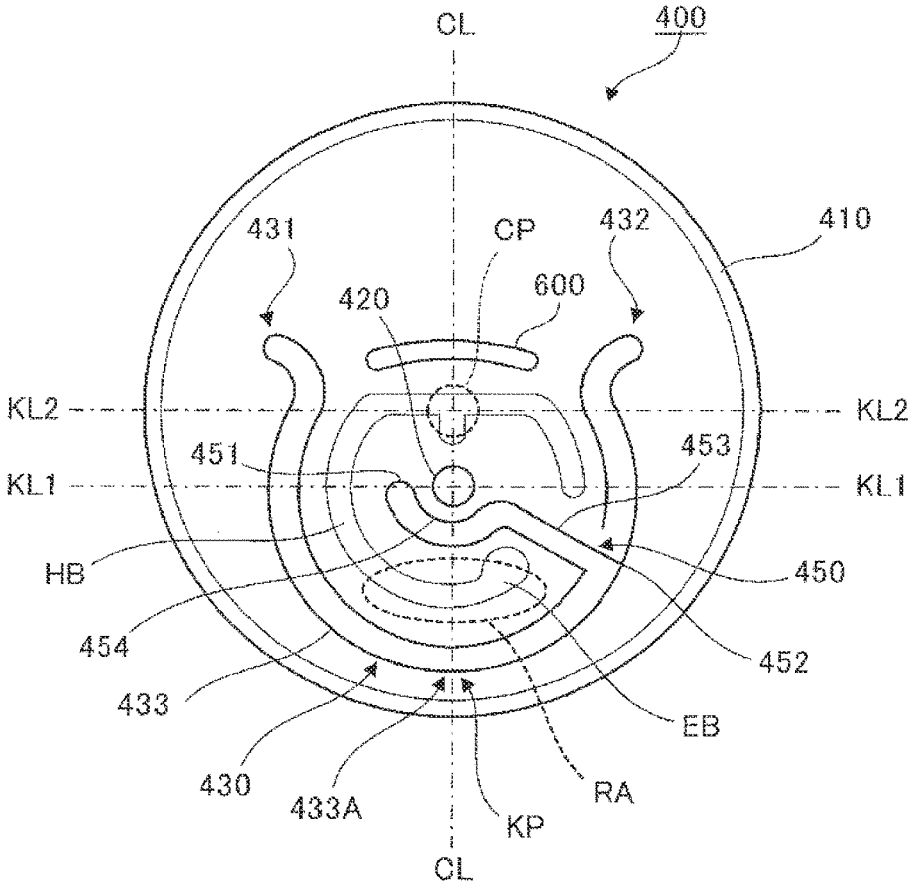
FIG. 2 is a front view showing a state of a panel before a tab is attached.

FIG. 2 is a front view showing a state of the panel 400 before the tab 500 is attached.

The panel 400 is formed in a disk shape, as described above. Moreover, the panel 400 has an outer peripheral edge 410 in which bending was applied. In the exemplary embodiment, in a state where the outer peripheral edge 410 and an upper edge section (not shown) of the container body 200 are brought into contact with each other, so-called seaming processing is applied to the outer peripheral edge 410 and the upper edge section. This fastens the panel 400 to the upper edge section of the container body 200. Moreover, in the panel 400, a protruding section (nipple) 420, which will be crushed when the tab 500 is fastened to the panel 400 to become the above-described rivet 900, is formed. The protruding section 420 is provided at a location deviated from the center section CP of the panel 400.

Moreover, on a surface of the panel 400, a first score line 430 is formed. The first score line 430 is formed to enclose a region RA, of the panel 400, pressed by the tab 500 (a pressed portion pressed by the tab 500). To additionally describe, the first score line 430 is formed around the region RA. Moreover, the first score line 430 is configured with a groove formed on the surface of the panel 400 and plays a role of inducing breakage of the panel 400 (to be described later). To additionally describe, the first score line 430 is able to be grasped as a breakage prediction line on which breakage of the panel 400 is predicted.

Moreover, the first score line 430 is formed to curve toward the outer peripheral edge 410 of the panel 400, and is formed in substantially a U shape when the panel 400 is viewed from the front. Further, the first score line 430 includes one end section 431 and the other end section 432 on the center section CP side of the panel 400, and a vertex section 433A on the outer peripheral edge 410 side of the panel 400.

The one end section 431 of the first score line 430 is arranged on one side of two regions that face each other with the center line CL (also refer to FIG. 1) of the tab 500 interposed therebetween. To additionally describe, the one end section 431 is arranged on one side of two regions that face each other with the center line CL along the longitudinal direction of the tab 500 interposed therebetween. Moreover, the other end section 432 is arranged on the other side of two regions that face each other with the center line CL interposed therebetween. Moreover, in the exemplary embodiment, the first score line 430 is arranged to be linearly symmetric with respect to the center line CL of the tab 500 as a symmetrical axis.

Moreover, in the exemplary embodiment, by arranging the one end section 431 and the other end section 432 in a state of being separated from each other, between the one end section 431 and the other end section 432, there is generated a state providing a discontinuous section where the first score line 430 is not provided. By providing the discontinuous section, a later-described tongue section is not separated from the panel 400, and the tongue section is in a state of attaching to the panel 400. It should be noted that, in the exemplary embodiment, the center line CL of the tab 500 passes through the center section CP of the panel 400 and the protruding section 420 formed on the panel 400, as shown in FIG. 2.

In addition, in the exemplary embodiment, in a case where a first virtual line KL1, which is a virtual line that is orthogonal to the above-described center line CL and passes through the protruding section 420 (rivet 900), is assumed, the above-described one end section 431 and the other end section 432 are provided closer to the center section CP side of the panel 400 than the first virtual line KL1. To additionally describe, in FIG. 1, the one end section 431 and the other end section 432 are provided upward of the rivet 900. Moreover, the vertex section 433A is provided in one of two regions that face each other with a second virtual line KL2, which is a virtual line that is orthogonal to the above-described center line CL and passes through the center section CP of the panel 400, interposed therebetween, and the one end section 431 and the other end section 432 are provided in the other region. Further, in the one region, the protruding section 420 is provided.

To describe further, the protruding section 420 that will become the rivet 900 is provided in a portion of the panel 400 enclosed by the first score line 430, which is positioned closer to the vertex section 433A side than the one end section 431 and the other end section 432 of the first score line 430. Moreover, as shown in FIG. 2, the first score line 430 includes a curved section 433. The curved section 433 is provided to connect the one end section 431 and the other end section 432, swell toward a side on which the protruding section 420 is provided, and pass through closer to the outer peripheral edge 410 side of the panel than the protruding section 420.

Moreover, the curved section 433 has the vertex section 433A at a location crossing the center line CL. In addition, in the can lid 300 in the exemplary embodiment, in the region of the panel 400 enclosed by the first score line 430, a reinforcing bead HB that increases stiffness of the region enclosed by the first score line 430 is formed. Moreover, on one end section of the reinforcing bead HB, an embossment EB, which protrudes upward (outward of the beverage can 100) and is pressed by the tip end of the tab 500, is provided. By providing the embossment EB, breakage of the panel 400 on a second score line 450 (to be described in detail later) is likely to be caused, as compared to a case in which the embossment EB is not provided.

Here, in the exemplary embodiment, by operation of the tab 500 by a user, the region enclosed by the first score line 430 is pressed by the tab 500, and accordingly, breakage of the panel 400 is caused on the location where the first score line 430 is formed (to be described in detail later). This causes the region on which the first score line 430 is formed to be in the tongue shape, and also causes the region to be bent toward the inside of the beverage can 100. Consequently, an opening that plays a role of a place a person drinks from is formed in the beverage can 100. It should be noted that, in this specification, hereinafter, the above-described tongue-shaped portion formed by breakage caused on the first score line 430 is referred to as a tongue section, in some cases.

Moreover, on the surface of the panel 400, the second score line 450 is formed. It should be noted that the second score line 450 is also configured with a groove formed on the surface of the panel 400 and plays a role of inducing breakage of the panel 400. Of the two regions facing each other with the first virtual line KL1 interposed therebetween, the second score line 450 is provided in the region where the vertex section 433A (the vertex section 433A of the first score line 430) is provided.

Moreover, the second score line 450 includes one end section 451 and the other end section 452. Here, the other end section 452 of the second score line 450 is connected to the curved section 433 of the first score line 430. Accordingly, in the exemplary embodiment, the score line branches at a location where the first score line 430 and the second score line 450 are connected.

To describe the second score line 450 further, the other end section 452 of the second score line 450 is connected to a portion positioned between the center line CL and the first virtual line KL1 in the curved section 433 of the first score line 430. To describe further in detail, the other end section 452 of the second score line 450 is connected to a portion positioned between the vertex section 433A and the other end section 432 of the first score line 430. To describe further, the other end section 452 of the second score line 450 is connected to, of the first score line 430, a location other than the location where the vertex section 433A is provided.

To describe further, the connecting section of the first score line 430 and the second score line 450 is provided at a location other than a crossing location KP where the center line CL and the first score line 430 cross each other. Moreover, in the exemplary embodiment, the second score line 450 is provided to head toward the inside of the region enclosed by the first score line 430 from the connecting section with the first score line 430. Moreover, in the exemplary embodiment, the connecting section of the first score line 430 and the second score line 450 is provided closer to a side where the above-described crossing location KP is provided than the first virtual line KL1 arranged in a relation orthogonal to the center line CL. To describe further, the connecting section of the first score line 430 and the second score line 450 is provided closer to a side where the region RA is positioned than the first virtual line KL1 arranged in a relation orthogonal to the center line CL.

Moreover, in the exemplary embodiment, the distance between the connecting section of the first score line 430 and the second score line 450 and the one end section 431 of the first score line 430 is larger than the distance between the connecting section and the other end section 432 of the first score line 430. To additionally describe, the length of the portion positioned between the one end section 431 of the first score line 430 and the above-described connecting section is longer than the length of the portion positioned between the other end section 432 of the first score line 430 and the above-described connecting section.

It should be noted that, in the exemplary embodiment, the description has been given of a case where the second score line 450 is provided to head in the lower right direction in the figure; however, the second score line 450 may be provided to head in the lower left direction in the figure. In this case, the second score line 450 is connected to a portion positioned between the vertex section 433A and the one end section 431 of the first score line 430.

On the other hand, the one end section 451 of the second score line 450 is provided in proximity to the protruding section 420. To describe further, the one end section 451 of the second score line 450 is arranged in one of the two regions facing with the centerline CL interposed therebetween, and the other end section 452 of the second score line 450 is arranged in the other one of the two regions. To describe further, the second score line 450 includes a linear section 453 heading for the protruding section 420 from the other end section 452. Further, the second score line 450 includes a curved section 454. The curved section 454 is arranged to be connected to the linear section 453, and have a distance with the protruding section 420 formed into a circular-cylindrical shape, and is provided to be along the protruding section 420.

Here, the curved section 454 is formed between the protruding section 420 and the first score line 430. To describe in more detail, the curved section 454 is formed between the vertex section 433A of the first score line 430 and the protruding section 420. To additionally describe, on the center line CL, the curved section 454 of the second score line 450 is arranged between the protruding section 420 and the first score line 430.

Moreover, the curved section 454 is provided to pass between the region RA, of the panel 400, pressed by the tab 500 (the pressed portion pressed by the tab 500) and the protruding section 420. To additionally describe, in the exemplary embodiment, the second score line 450 is provided to pass through closer to a side where the protruding section 420 (the rivet 900) is provided than the above-described region RA, and also the second score line 450 is provided to pass between the above-described region RA and the protruding section 420.

Moreover, in the exemplary embodiment, the curved section 454 of the second score line 450 is provided to cross the above-described center line CL that passes through the region RA, which is pressed by the tab 500, and the protruding section 420 (the straight line passing through the region RA and the protruding section 420). To describe further, the second score line 450 in the exemplary embodiment, after passing between the region RA and the protruding section 420, travels along the direction crossing the center line CL, and is connected to the first score line 430. To additionally describe, the second score line 450 in the exemplary embodiment is formed along the direction that crosses the direction of providing the center line CL.

To describe further, the second score line 450 traveling in the direction crossing the center line CL travels to gradually approach the side on which the region RA is positioned, of the side on which the region RA is positioned and the side on which the protruding section 420 is provided. More specifically, the second score line 450 travels toward the first score line 430 so that the linear section 453 of the second score line 450 gradually approaches the side on which the region RA is positioned.

To describe further, the second score line 450, after passing between the region RA and the protruding section 420, travels to be gradually separated from the first virtual line KL1, and is connected to the first score line 430. It should be noted that, at this time, the second score line 450 passes beside the region RA. To additionally describe, the second score line 450, after passing between the region RA and the protruding section 420, travels to be gradually separated from the first virtual line KL1, which is a straight line orthogonal to the straight line passing the vertex section 433A of the first score line 430 and the center section CP of the panel 400 and is a straight line passing through the protruding section 420, travels aside the region RA, and is connected to the first score line 430.

Here, also with reference to FIGS. 3A to 3E (a diagram for illustrating the states of the panel 400), the states of the panel 400 when the tab 500 is operated will be described. It should be noted that, in each of FIGS. 3A to 3E, the diagram viewing the panel 400 from the front is shown. Moreover, in each of FIGS. 3A to 3E, illustration of the tab 500 is omitted.

In the exemplary embodiment, when rear end section of the tab 500 is pulled up by a user, the second edge section 502 of the tab 500 (refer to FIG. 1) presses the above-described region RA (refer to FIG. 2) positioned between the curved section 454 of the second score line 450 and the vertex section 433A of the first score line 430. Then, when the region RA is pressed by the tab 500, first, breakage of the panel 400 is caused on the curved section 454 of the second score line 450 provided to pass between the region RA and the rivet 900 (the protruding section 420) (refer to FIG. 3B). Thereafter, in the exemplary embodiment, breakage of the panel 400 proceeds along the second score line 450, and there is generated a state in which the panel 400 is broken to the connecting section of the first score line 430 and the second score line 450.

Figure 3A:
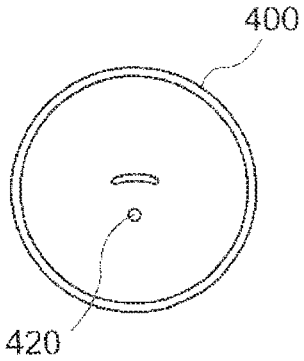
FIGS. 3A to 3E are diagrams for illustrating states of the panel.
Figure 3B:
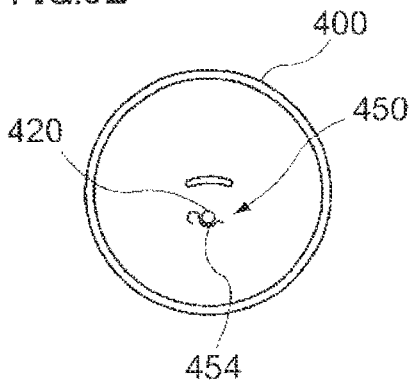
Figure 3C:
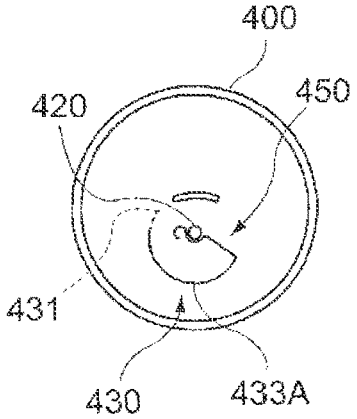
Figure 3D:
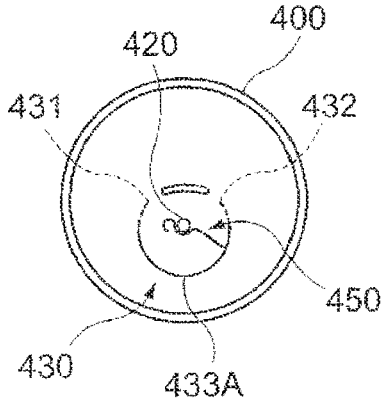

Here, in the exemplary embodiment, the score line branches at the above-described connecting section of the first score line 430 and the second score line 450. Accordingly, after breakage of the panel 400 proceeded from the above-described curved section 454 of the second score line 450 to the above-described connecting section, in the exemplary embodiment, as shown in FIG. 3C, breakage heading for the one end section 431 of the first score line 430 from the connecting section proceeds. Moreover, as shown in FIG. 3D, breakage heading for the other end section 432 of the first score line 430 from the connecting section also proceeds.

Figure 3E:
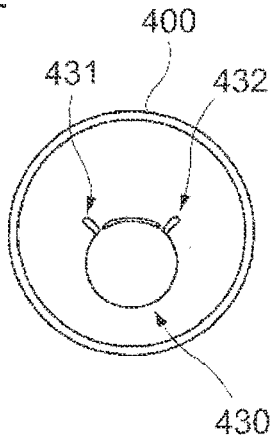

Thereafter, the rear end section of the tab 500 is further pulled up by the user, and thereby breakage of the panel 400 to the one end section 431 and the other end section 432 of the first score line 430 further proceeds. This causes the region enclosed by the first score line 430 to become the above-described tongue section. In addition, the tongue section is bent at a basal part of the tongue section (the location positioned between the one end section 431 and the other end section 432 of the first score line 430), and as shown in FIG. 3E, the tongue section enters into the inside of the beverage can 100. Consequently, in the beverage can 100, an opening that functions as a place a person drinks from is formed. It should be noted that, although detailed description will be given later, when the pulled-up tab 500 is returned to the original state, the tab 500 is bent.

Here, breakage of the panel 400 caused on the first score line 430 and the second score line 450 will be further described with reference to FIG. 4 (a diagram for illustrating breakage caused in the panel 400). In the exemplary embodiment, as described above, by pulling up the rear end section of the tab 500 by a user, the above-described region RA (refer to FIG. 2) positioned between the curved section 454 of the second score line 450 and the vertex section 433A of the first score line 430 is pressed by the tab 500.

To additionally describe, of the region enclosed by the first score line 430, the region positioned on a side of the vertex section 433A of the first score line 430 than the second score line 450 is pressed by the tab 500. This causes, first, breakage of the panel 400 at the curved section 454 of the second score line 450. Thereafter, breakage of the panel 400 proceeds along the second score line 450, and then breakage proceeds to the connecting section (the crossing point) of the first score line 430 and the second score line 450.

Figure 4:
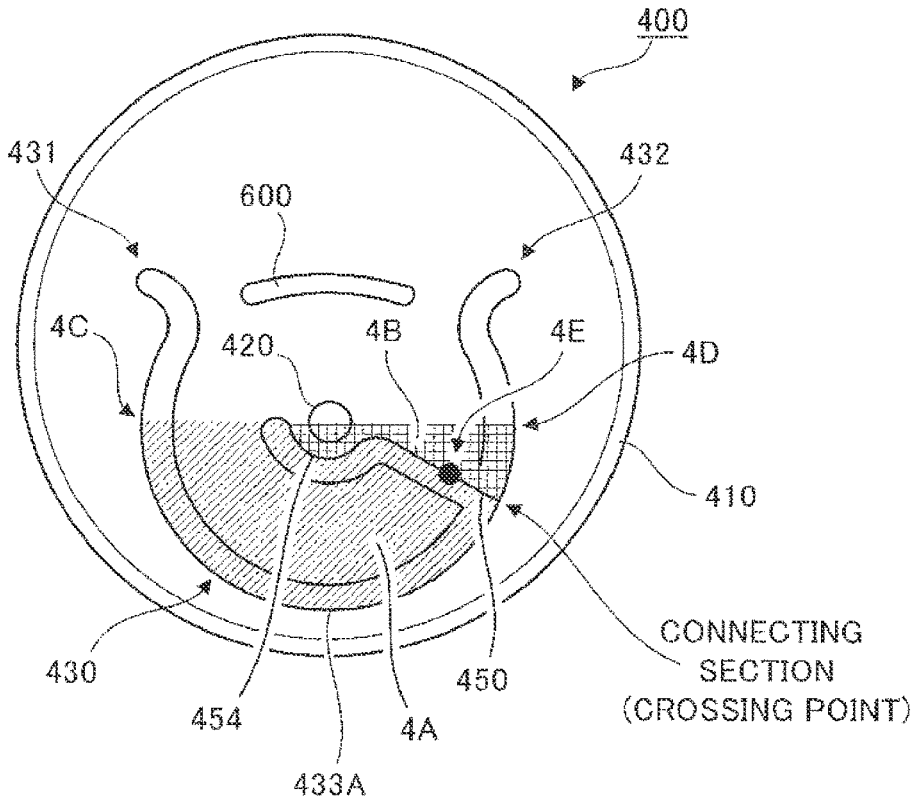
FIG. 4 is a diagram for illustrating breakage caused in the panel.

Thereafter, by further pressing the region RA (refer to FIG. 2) of the panel 400 by the second edge section 502 of the tab 500, breakage of the panel 400 proceeds along the first score line 430, to thereby bring into a state in which breakage of the panel 400 is caused to the location indicated by the reference sign 4C in FIG. 4. To additionally describe, there is caused a state in which breakage of the panel 400 is caused to the vicinity of the location where the first virtual line KL1 (refer to FIG. 2) that passes through the protruding section 420 and the first score line 430 cross each other.

This forms an opening in the region 4A in FIG. 4. To additionally describe, by breakage of the panel 400 on the second score line 450 and breakage of the panel 400 in the portion of the first score line 430 positioned closer to the one end section 431 than the above-described connecting section, a small opening (hereinafter, referred to as a small opening) is formed in part of the panel 400.

Next, in the exemplary embodiment, by further pulling up the rear end section of the tab 500 by the user, the tab 500 inters into the inside of the beverage can 100 through the above-described small opening. Then, at this time, the tab 500 comes to press the location indicated by the reference sign 4E in FIG. 4. To additionally describe, the edge section of the small opening is pressed. To describe further, of the panel 400, a region 4B positioned above the location where the second score line 450 comes to be pressed. To describe further, a region positioned between the location of the first score line 430 positioned closer to the other end section 432 side than the above-described connecting section and the second score line 450 comes to be pressed by the tab 500.

Accordingly, in the exemplary embodiment, breakage of the panel 400 proceeds along the first score line 430, and the panel 400 is broken to the location indicated by the reference sign 4D. To additionally describe, there is caused a state in which breakage of the panel 400 is caused to the vicinity of the location where the first virtual line KL1 (refer to FIG. 2) that passes through the protruding section 420 and the first score line 430 cross each other. To describe further, breakage of the panel 400 is caused in the portion of the first score line 430 positioned closer to the other end section 432 side than the above-described connecting section, and the panel 400 is broken to the location indicated by the reference sign 4D.

Thereafter, in the exemplary embodiment, by further pulling up the rear end section of the tab 500 by the user, rotational moment comes to act on the above-described tongue section (detailed description will be given later), breakage of the panel 400 is further caused on the first score line 430. Specifically, breakage of the panel 400 is caused in both of a first portion of the first score line 430 positioned between the above-described location indicated by the reference sign 4C and the one end section 431 and a second portion of the first score line 430 positioned between the above-described location indicated by the reference sign 4D and the other end section 432.

Thereafter, as described above, the tongue section is bent at a basal part of the tongue section (the location positioned between the one end section 431 and the other end section 432 of the first score line 430), and as shown in FIG. 3E, the tongue section enters into the inside of the beverage can 100. Consequently, in the beverage can 100, the opening is formed.

It should be noted that, in the exemplary embodiment, the first score line 430 is arranged in linearly symmetrical relation with respect to the center line CL as a symmetrical axis. Therefore, breakage of the panel 400 from the location indicated by the reference sign 4C toward the one end section 431 and breakage of the panel 400 from the location indicated by the reference sign 4D toward the other end section 432 are caused at substantially a same timing. To additionally describe, breakage of the panel 400 from the location indicated by the reference sign 4C toward the one end section 431 and breakage of the panel 400 from the location indicated by the reference sign 4D toward the other end section 432 proceed simultaneously.

Here, in the exemplary embodiment, as described above, breakage of the panel 400 is caused on the second score line 450, first. Next, in the exemplary embodiment, breakage of the panel 400 is caused at the portion of the first score line 430 positioned between the above-described connecting section and the location indicated by the reference sign 4C.

Thereafter, breakage of the panel 400 is caused at the portion of the first score line 430 positioned between the above-described connecting section and the location indicated by the reference sign 4D. To additionally describe, in the exemplary embodiment, breakage of the panel 400 from the above-described connecting section toward the one end section 431 of the first score line 430 and breakage of the panel 400 from the above-described connecting section toward the other end section 432 of the first score line 430 are not caused simultaneously, but breakage of the panel 400 is caused in a temporally-shifted state.

To describe further, in the exemplary embodiment, the connecting section of the first score line 430 and the second score line 450 is not positioned on the center line CL of the tab 500, and the connecting section of the first score line 430 and the second score line 450 is positioned at a position deviated from the center line CL. Accordingly, breakage of the panel 400 from the connecting section toward the one end section 431 of the first score line 430 and breakage of the panel 400 from the connecting section toward the other end section 432 of the first score line 430 are not caused simultaneously, but breakage of the panel 400 is caused in a temporally-shifted state.

To describe in detail, breakage from the connecting section toward the one end section 431 is caused first, and breakage from the connecting section toward the other end section 432 is next caused. Accordingly, in the exemplary embodiment, as compared to a case where breakage of the panel 400 toward the one end section 431 and breakage of the panel 400 toward the other end section 432 are caused simultaneously, an operation load on the tab 500 when the opening is formed in the panel 400 is reduced.

To describe further, in the exemplary embodiment, when the tab 500 is operated by a user and the tip end section (the second edge section 502) of the tab 500 presses the panel 400, the tip end section presses a portion positioned below the second score line 450 (a portion positioned closer to the vertex section 433A than the second score line 450), but does not press a portion positioned above the second score line 450.

To additionally describe, the exemplary embodiment does not have a configuration in which both of the portion positioned below the second score line 450 and the portion positioned above the second score line 450 are simultaneously pressed by the tab 500, but has a configuration in which the tab 500 contacts the portion positioned below the second score line 450 only, and thereby only this portion is pressed by the tab 500. To describe further, in the exemplary embodiment, the above-described region 4B and the tab 500 are configured to be brought into contact after the above-described small opening is formed in the panel 400.

Accordingly, in the exemplary embodiment, breakage of the panel 400 from the above-described connecting section toward the one end section 431 of the first score line 430 and breakage of the panel 400 from the above-described connecting section toward the other end section 432 of the first score line 430 are not caused simultaneously, but breakage of the panel 400 is caused in a temporally-shifted state. This reduces the operation load on the tab 500 when the tab 500 is pulled up, as compared to the case where breakage of the panel 400 is caused at the same time.

It should be noted that, in the exemplary embodiment, breakage of the panel 400 from the location indicated by the reference sign 4C toward the one end section 431 and breakage of the panel 400 from the location indicated by the reference sign 4D toward the other end section 432 are caused at substantially a same timing. By the way, when breakage is caused, the angle of the tab 500 with respect to the panel 400 becomes large. Therefore, in this case, the operation load on the tab 500 does not become so large, and accordingly, degradation in operability of the tab 500 is suppressed.

It should be noted that, in the exemplary embodiment, as shown in FIG. 2, a groove 600 is provided in the region positioned between the one end section 431 and the other end section 432 of the first score line 430, though description thereof was omitted above. The groove 600 is formed to be curved to draw a circular arc, and is provided to head from the side on which the one end section 431 of the first score line 430 is provided toward the side on which the other end section 432 of the first score line 430 is provided. Consequently, in the beverage can 100 in the exemplary embodiment, bending of the tongue section is likely to occur. Moreover, in the exemplary embodiment, since the groove 600 is formed to be curved, the tongue section having been bent is hardly returned to the original state.

It should be noted that the groove 600 may have any one of the shapes shown in FIGS. 5A to 5D.

Figure 5A:
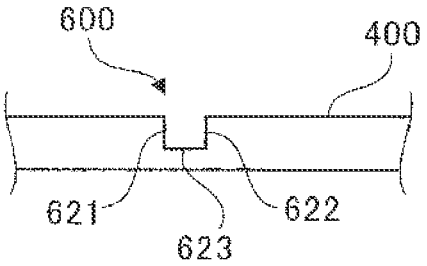
FIGS. 5A to 5D are diagrams showing other examples of a shape of a groove.
Figure 5B:
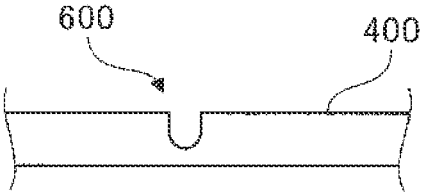

FIGS. 5A to 5D are diagrams showing other examples of the shape of the groove 600. The groove 600 is, for example, as shown in FIG. 5A, able to be formed into a shape including a first side surface 621 and a second side surface 622 having a relation of substantially being orthogonal to the surface of the panel 400, and a flat bottom surface 623 connecting the first side surface 621 and the second side surface 622. It should be noted that a bottom section of the groove 600 may be assigned with curvature as shown in FIG. 5B.

Figure 5C:
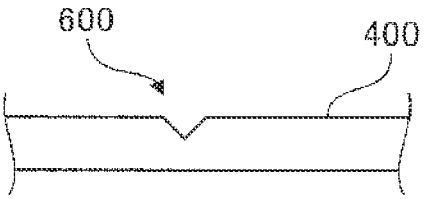
Figure 5D:
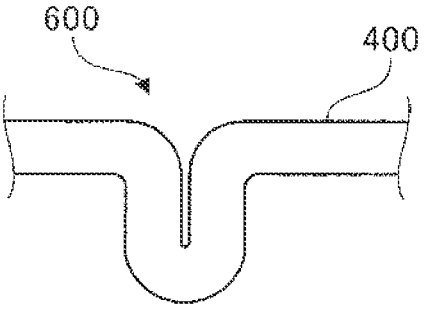

Moreover, the groove 600 is able to be formed into a shape having a triangular cross section as shown in FIG. 5C. Moreover, in the above description, stiffness of the basal part of the tongue section is decreased by forming the groove 600; however, as shown in FIG. 5D, the stiffness may be decreased by applying bending processing to the basal part of the tongue section. Moreover, in the exemplary embodiment, as shown in FIG. 4, the groove 600 was formed to curve toward a side opposite to the side where the protruding section 420 is provided; however, the groove 600 may be formed to curve toward the side where the protruding section 420 is provided. It should be noted that, in the exemplary embodiment, the description was given to a mode in which the groove 600 was provided; however, the groove 600 is not necessarily required, and the groove 600 may be omitted.

Figure 6:
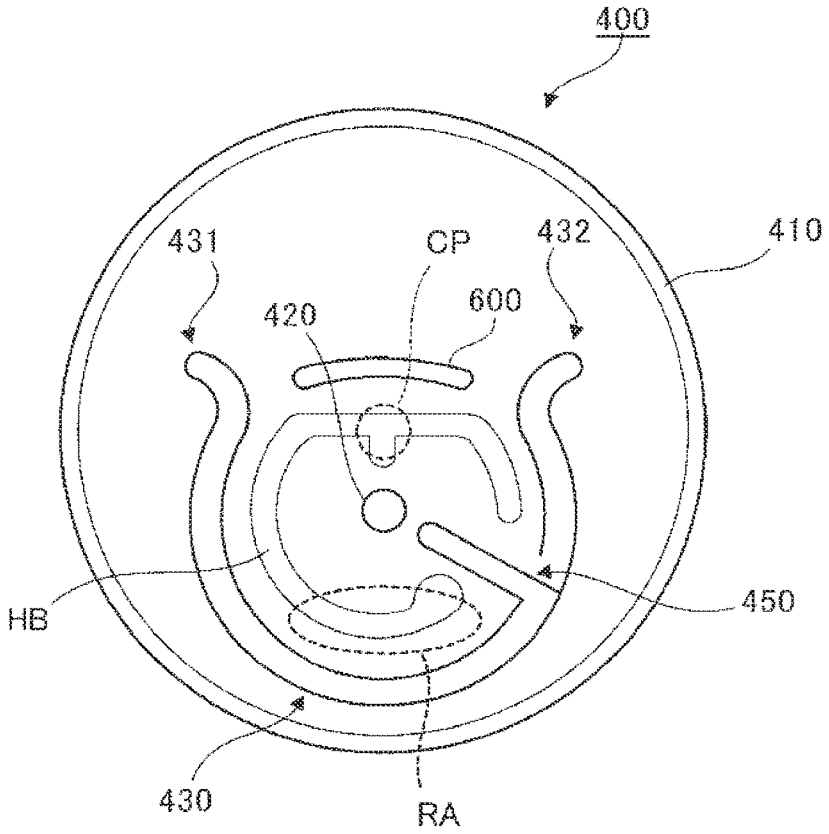
FIG. 6 is a diagram showing another configuration example of the panel.

Moreover, in the exemplary embodiment, as described above, a case in which the second score line 450 is provided to pass between, of the panel 400, the region RA pressed by the tab 500 and the protruding section 420 was exemplified; however, the mode of arranging the second score line 450 is not limited to the mode like this. For example, as shown in FIG. 6 (a diagram showing another configuration example of the panel 400), a second score line 450 that does not pass between the region RA and the protruding section 420 may be provided. Further, in the above description, the second score line 450 is depicted as substantially a straight line; however, the second score line 450 is not limited to the straight line, but may be a curved line or other line.

Next, the tab 500 will be described in detail.

Figure 7B:
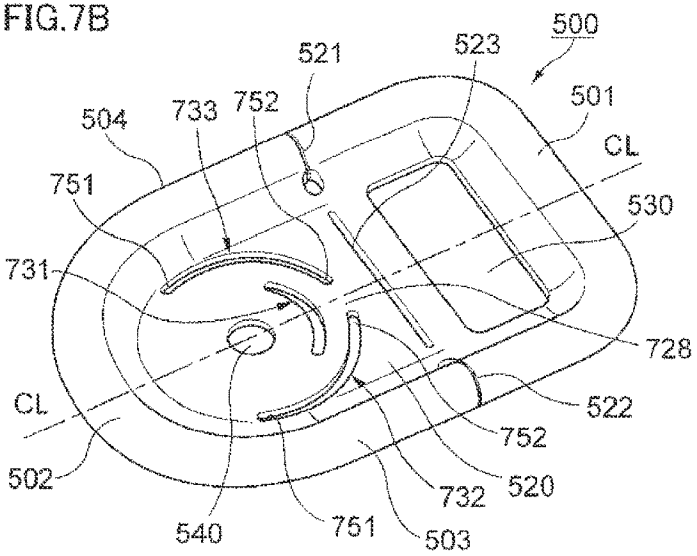
FIGS. 7A to 7D are diagrams for illustrating a configuration of the tab.
Figure 7D:
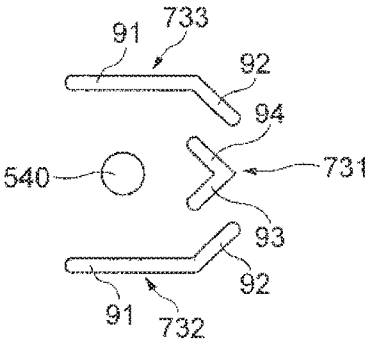
Figure 7A:
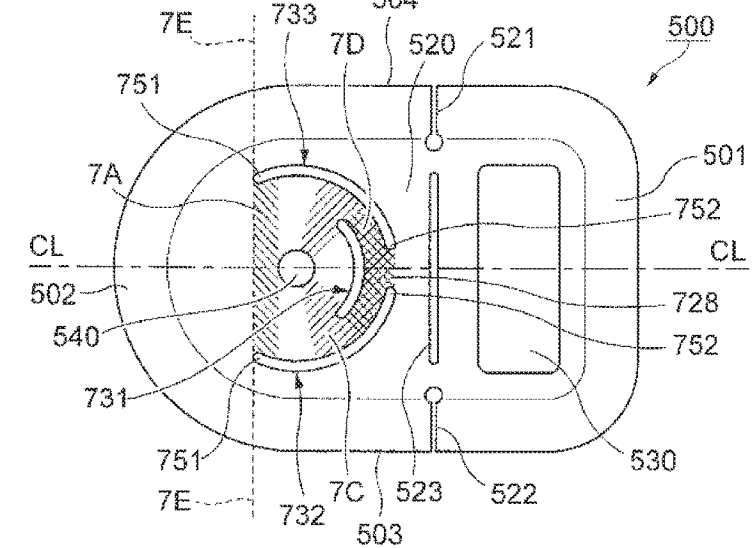

FIGS. 7A to 7D are diagrams for illustrating a configuration of the tab 500. FIGS. 8A to 8D are diagram showing movement of the tab 500 when the opening is formed in the beverage can 100. It should be noted that FIG. 7A is a front view of the tab 500 and FIG. 7B is a perspective view of the tab 500.

The tab 500 in the exemplary embodiment includes, as shown in FIGS. 7A and 7B, a tab main body section 520 that is formed into a rectangular shape and a plate-like shape. It should be noted that, in the exemplary embodiment, bending processing (curling processing) is applied to an outer peripheral edge of the tab main body section 520, and accordingly, the outer peripheral edge of the tab main body section 520 is in a state of curling into the inside. To additionally describe, at the edge section provided all around the tab main body section 520, curling sections are formed. Consequently, in the tab 500 in the exemplary embodiment, bending stiffness is increased. Moreover, the shape of the cross section of the bending processing in the outer peripheral edge of the tab 500 is not limited to substantially a circular shape, as in the exemplary embodiment; however, the shape may be an elliptic, rectangular, triangular or polygonal shape.

Further, in the tab 500, a through hole (a finger hole) 530 in which user's finger is caught is formed on a side (a tab tail side) opposite to the side on which the second edge section 502 that presses the panel 400 is provided. It should be noted that the through hole 530 is able to be omitted. Moreover, in the tab 500, an insertion hole 540 into which the protruding section 420 (refer to FIG. 2) provided in the panel 400 is inserted is formed on the tip end section side (the second edge section side 502) of the tab 500.

Moreover, in the exemplary embodiment, of the four curling sections provided all around the tab main body section 520, in the curling section provided along the longitudinal direction of the tab 500, a first curling section slit 521 is formed. To additionally describe, the tab 500 of the exemplary embodiment includes a first side edge 503 formed to head from the first edge section 501 toward the second edge section 502, and a second side edge 504 that is formed to similarly head from the first edge section 501 toward the second edge section 502 and is arranged on a side opposite to the first side edge 503, and in the exemplary embodiment, in the curling section provided along the second side edge 504, the first curling section slit 521 is formed.

Moreover, of the four curling sections, in another curling section provided along the longitudinal direction of the tab 500, a second curling section slit 522 is formed. To additionally describe, in the another curling section provided along the first side edge 503, the second curling section slit 522 is formed.

Further, of the tab main body section 520, in the portion positioned between the first curling section slit 521 and the second curling section slit 522, a groove 523 is formed. Moreover, on the location where an end section of the first curling section slit 521 is positioned and the location where an end section of the second curling section slit 522 is positioned, punching processing in a circular shape is applied to relief concentration of stress.

Here, the first curling section slit 521, the second curling section slit 522 and the groove 523 are provided in a state along the short direction of the tab 500. Moreover, the first curling section slit 521, the second curling section slit 522 and the groove 523 are arranged to be on the same straight line. In addition, the first curling section slit 521, the second curling section slit 522 and the groove 523 are arranged between the insertion hole 540 and the through hole 530. Here, in the exemplary embodiment, the first curling section slit 521, the second curling section slit 522 and the groove 523 are formed in this manner, and accordingly, stiffness (bending stiffness) in the portions where these are formed is decreased.

In the exemplary embodiment, as the first curling section slit 521 and the second curling section slit 522 are observed, inside the slit processing, cross sections of the curling sections of the tab 500 having the same shape in a state of facing each other. At this time, if a load is applied in the direction to pull up the tab toward the first edge section 501 side of the tab 500, in the first curling section slit 521 and the second curling section slit 522, the above-described cross sections abut each other, and mutually receive loads in the compressing direction, to thereby compete against the above-described load in the pulling-up direction. This is because, when the tab 500 is pulled up to form the opening in the panel 400, the tab 500 begins to be bent at a portion of the tab main body section 520 between the first curling section slit 521 and the second curling section slit 522; however, since the curling sections facing in the first curling section slit 521 and the second curling section slit 522 endure the above-described loads in the compressing direction, the bending is inhibited, and thereby the bending stiffness in the longitudinal direction of the tab 500 is secured, and the tab 500 is escaped being bent. As a result, the second edge section 502 side of the tab 500 presses the panel 400, to thereby form the opening in the panel 400. After the opening is formed, the pulled-up tab 500 stands substantially in the vertical direction to the panel 400, and the first edge section 501 side of the tab 500 is brought into a state of protruding from the top surface of the panel 400. Consequently, if a load in a direction of returning to the first edge section 501 side of the tab 500 in order to bend the first edge section 501 side in a direction opposite to the above-described pulling-up direction, bending is to start from a portion of the tab main body section 520 that connects the first curling section slit 521 and the second curling section slit 522. However, since bending in this case is, different from the above-described case of pulling up, the bending in a direction to separate the cross sections of the curling sections of the tab 500, the facing first curling section slit 521 and second curling section slit 522 are not a factor to inhibit the bending, and accordingly, the tab 500 begins to be bent at the portion of the tab main body section 520 between the first curling section slit 521 and the second curling section slit 522. At this time, if the groove 523 has been formed, the above-described bending is likely to be made further.

Consequently, in the exemplary embodiment, if a load is applied to the rear end section side of the tab 500, the tab 500 is bent. Accordingly, in the exemplary embodiment, when the tab 500 pulled up by a user is operated to be returned to the original state, the tab 500 is bent, to thereby maintain a state in which the tip end section side of the tab 500 is inserted into the inside of the beverage can 100. It should be noted that, in the exemplary embodiment, the groove 523 is formed between the first curling section slit 521 and the second curling section slit 522 to decrease the stiffness in the portion; however, the stiffness is able to be decreased not only by forming such a groove, but also by applying the bending processing. Moreover, the groove 523 is not necessarily required, and the groove 523 may be omitted.

In addition, in the exemplary embodiment, in the tab main body section 520, a first main body section slit 731 to a third main body section slit 733 are provided to penetrate through the tab main body section 520. Here, the first main body section slit 731 to the third main body section slit 733 are formed to draw circular arcs along an outer peripheral edge of the insertion hole 540 that has been formed into a circular shape. To additionally describe, the first main body section slit 731 to the third main body section slit 733 are formed to draw the circular arcs around the location where the insertion hole 540 is provided (the location of the tab 500 connected to the panel 400). It should be noted that the shape of the first main body section slit 731 to the third main body section slit 733 is not limited to the circular arc shape. As necessary, the shape may be other than the circular arc, as shown in FIGS. 7C and 7D.

Figure 7C:
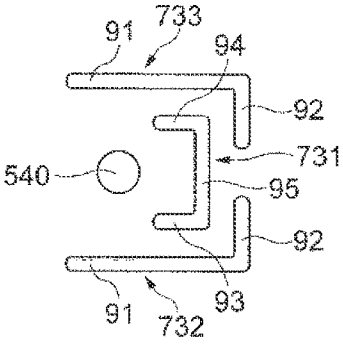

In FIG. 7C, each of the second main body section slit 732 and the third main body section slit 733 is configured with a first linear section 91 and a second linear section 92. Here, the first linear section 91 is formed along the longitudinal direction of the tab 500, and the second linear section 92 is formed along the short direction of the tab 500. Moreover, the first main body section slit 731 is configured with a first linear section 93, a second linear section 94 and a third linear section 95. Here, the first linear section 93 and the second linear section 94 are formed along the longitudinal direction of the tab 500. In addition, the third linear section 95 is formed along the short direction of the tab 500, and connects the first linear section 93 and the second linear section 94.

Moreover, in FIG. 7D, similar to FIG. 7C, the first linear section 91 and the second linear section 92 are provided; however, in FIG. 7D, the second linear section 92 is arranged in a state of being inclined with respect to the longitudinal direction and the short direction of the tab 500. In addition, in FIG. 7D, the third linear section 95 (refer to FIG. 7C) is omitted, and the first linear section 93 and the second linear section 94 are arranged in a state of being inclined with respect to the longitudinal direction and the short direction of the tab 500.

Here, as shown in FIGS. 7A and 7B, the first main body section slit 731, as an example of a first through hole, is provided on a side closer to the insertion hole 540 than the second main body section slit 732, as an example of a second through hole, and the first main body section slit 731 is provided on a side closer to the insertion hole 540 than the third main body section slit 733, as an example of a third through hole. Moreover, the second main body section slit 732 and the third main body section slit 733 are formed to draw circular arcs along the outer peripheral edge of the insertion hole 540, as described above, and provided to pass through locations that are in the same distance from the insertion hole 540. It should be noted that the same is true for the first main body section slit 731, and thereby the first main body section slit 731 is provided to pass through locations that are in the same distance from the insertion hole 540.

To describe further, the first main body section slit 731 is provided closer on the rear end section side (the first edge section 501 side) of the tab 500 than the insertion hole 540. To additionally describe, the first main body section slit 731 is provided between the first edge section 501 and the insertion hole 540 of the tab 500.

Moreover, each of the second main body section slit 732 and the third main body section slit 733 includes one end 751 and the other end 752. Here, the one end 751 is positioned closer to the second edge section 502 side of the tab 500 than the insertion hole 540. In addition, the other end 752 is positioned closer to the first edge section 501 side of the tab 500 than the insertion hole 540. Moreover, the other end 752 is arranged at a position heading for the center line CL (also refer to FIG. 1) between the first main body section slit 731 and the first edge section 501 of the tab 500. To describe further, the other end 752 is provided in a region positioned between the first main body section slit 731 and the first edge section 501 of the tab 500.

Moreover, the second main body section slit 732 is formed to pass beside one of the insertion hole 540 and the first main body section slit 731 from the location where the above-described one end 751 is positioned, and to head for, between the first main body section slit 731 and the first edge section 501 of the tab 500, the center line CL of the tab 500. To describe further, the second main body section slit 732 is formed to pass between the insertion hole 540 and the first side edge 503 of the tab 500 from the location where the above-described one end 751 is positioned, and between the first main body section slit 731 and the first side edge 503 of the tab 500, to head for the first edge section 501 side of the tab 500, and also head for the second side edge 504 side of the tab 500.

Moreover, the third main body section slit 733 is also formed to pass beside one of the insertion hole 540 and the first main body section slit 731 from the location where the above-described one end 751 is positioned, and to head for, between the first main body section slit 731 and the first edge section 501 of the tab 500, the center line CL of the tab 500. To additionally describe, the third main body section slit 733 is formed to pass between the insertion hole 540 and the second side edge 504 of the tab 500 from the location where the above-described one end 751 is positioned, and between the first main body section slit 731 and the second side edge 504 of the tab 500, to head for the first edge section 501 side of the tab 500, and also head for the first side edge 503 side of the tab 500.

In addition, in the exemplary embodiment, as described above, the other ends 752 are positioned between the first main body section slit 731 and the first edge section 501 of the tab 500 to head for the center line CL of the tab 500, and the second main body section slit 732 and the third main body section slit 733 are in a state of extending between the first main body section slit 731 and the first edge section 501 of the tab 500 toward the center line CL of the tab 500 from the above-described one ends 751 as starting points.

To describe further, each of the second main body section slit 732 and the third main body section slit 733 formed to draw circular arcs is provided to pass through a location where the distance from the insertion hole 540 becomes larger than the first main body section slit 731, and extends between the first main body section slit 731 and the first edge section 501 to a region approaching the center line CL of the tab 500. To describe further, each of the second main body section slit 732 and the third main body section slit 733 is provided to pass through a location separated by a predetermined separation distance from the insertion hole 540 and to pass through a location where the separation distance becomes larger than the distance between the first main body section slit 731 and the insertion hole 540, and extends between the first main body section slit 731 and the first edge section 501 to a region approaching the center line CL of the tab 500.

Moreover, the first main body section slit 731 is provided on the center line CL of the tab 500 (also refer to FIG. 1), and is formed into a shape that is linear symmetry with respect to the center line CL as the symmetrical axis. In addition, the second main body section slit 732 is arranged in one side of two regions facing each other with the center line CL of the tab 500 interposed therebetween, and the third main body section slit 733 is arranged in the other region side. Moreover, the second main body section slit 732 and the third main body section slit 733 are arranged in a relation of linear symmetry with respect to the center line CL of the tab 500 as the symmetrical axis.

Here, in the case where the first main body section slit 731 is formed in a shape of linear symmetry and the second main body section slit 732 and the third main body section slit 733 are provided in a relation of linear symmetry in this manner, when the tab 500 is pulled up by a user, inclination of the tab 500 is suppressed. To describe more specifically, inclination of the tab 500, in which one end section side in the short direction of the tab 500 is positioned above the other end section side, hardly occurs.

Moreover, though description was omitted above, in the exemplary embodiment, the other end 752 of the second main body section slit 732 and the other end 752 of the third main body section slit 733 are not connected. Consequently, in the exemplary embodiment, between the other end 752 of the second main body section slit 732 and the other end 752 of the third main body section slit 733, an intervening section 728 configured with the tab main body section 520 and intervening between the other end 752 of the second main body section slit 732 and the other end 752 of the third main body section slit 733 is provided.

With reference to FIGS. 8A to 8D, movement of the tab 500 will be described. It should be noted that, in FIGS. 8A to 8D, states of cross section of the tab 500 at the center line CL (refer to FIG. 1) are shown.

Figure 8A:
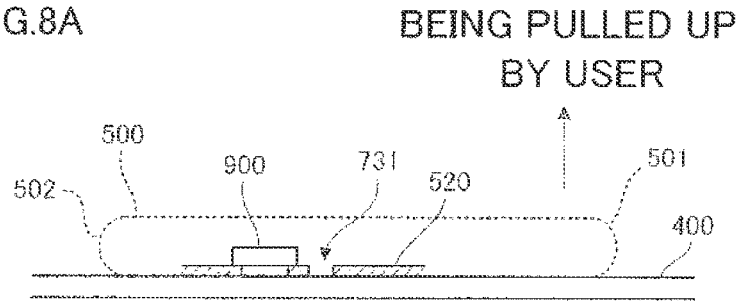
FIGS. 8A to 8D are diagrams showing movement of the tab when an opening is formed in the beverage can.
Figure 8B:
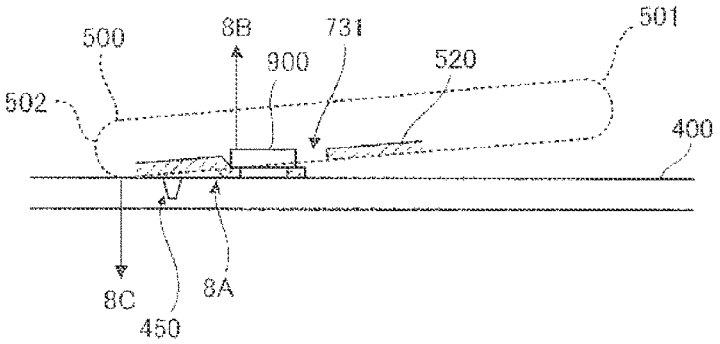

In the beverage can 100 of the exemplary embodiment, first, a user's finger is inserted between the rear end section of the tab 500 and the panel 400, and the rear end section of the tab 500 is pulled up as shown in FIGS. 8A and 8B. Here, when the pulling up is performed, the rear end section side of the tab 500 is floated above the panel 400. Moreover, in the tip end section side of the tab 500, the tip end section side of the tab 500 except for the tip end that is in contact with the panel 400 is also floated above the panel 400. This is because, as shown in FIG. 7A and FIG. 8B, by forming the first main body section slit 731, the region indicated by the reference sign 7D was less susceptible to restraint by the insertion hole 540, and since the other end sections of the second main body section slit 732 and the third main body section slit 733 extended between the first main body section slit 731 and the first edge section 501 side to the region heading for the center line CL of the tab 500, the region indicated by the reference sign 7D was given flexibility in deformation, and by pulling up the rear end section of the tab 500, the intervening section 728 shown in FIG. 7A was separated from the panel 400, the region of the reference sign 7D became dependent of the tab main body section 520 to be deformable, and the region 7D, which includes the intervening section 728 including the vicinity of both end sections of the first main body section slit 731, was deformed to be curved, to thereby make the state of the above-described slit 731 as shown in FIG. 8B possible. Further, by forming the one ends 751 of the second main body section slit 732 and the third main body section slit 733 between the insertion hole 540 and the second edge section 502 side as shown in FIG. 7A, bending of the tab 500 is started from the reference sign 7E that connects the above-described one ends 751, and accordingly, the tip end section side of the tab 500 is floated above the panel 400.

Here, when the tip end section side of the tab 500 is floated above the panel 400, as indicated by the reference sign 8A in FIG. 8B, of the tab main body section 520, the portion positioned closer to the tip end section side of the tab 500, except for the tip end that is in contact with the panel 400, than the rivet 900 is to move upward. Consequently, with respect to a left end of the rivet 900 shown in FIG. 8B, which is a portion of the rivet 900 positioned closer to the tip end section side of the tab 500, a load to pull upward (refer to arrow 8B in the figure) comes to act on. Moreover, in the case where the tab 500 is pulled up, the tip end section of the tab 500 is pressed against the panel 400.

As a result, in the exemplary embodiment, a shearing force comes to act on the second score line 450 provided to pass between the tip end section of the tab 500 and the rivet 900. Then, by the shearing force, at the location where the second score line 450 is provided, breakage of the panel 400 is caused. Then, by further performing pulling up of the rear end section of the tab 500, breakage of the panel 400 is also caused on the first score line 430 as described above.

It should be noted that, as described above (as shown in FIG. 7A), in the exemplary embodiment, there is provided a configuration in which the one end 751 provided to each of the second main body section slit 732 and the third main body section slit 733 is positioned closer to the tip end section side of the tab 500 than the insertion hole 540. Then, in the exemplary embodiment, since such a configuration is employed, the tip end section side except for the tip end of the tab 500 is floated above the panel 400, and accordingly, as shown in FIG. 8B, the whole tab 500 becomes inclined to the panel 400. Then, by generating the inclination, the user's finger is able to be inserted between the rear end section of the tab 500 and the panel 400.

To describe more specifically, in the exemplary embodiment, the one end 751 provided to each of the second main body section slit 732 and the third main body section slit 733 is positioned closer to the tip end section side of the tab 500 than the insertion hole 540. Then, in this case, the region positioned between the one ends 751 and the insertion hole 540 (the region 7A indicated by oblique lines in FIG. 7A) is floated above the panel 400 as indicated by reference sign 8A in FIG. 8B, when pulling up of the tab 500 is started. Then, the tip end section side except for the tip end of the tab 500 is floated above the panel 400, and accordingly, the whole tab 500 becomes inclined to the panel 400.

It should be noted that, in a case where the portion positioned in the above-described region 7A does not exist (for example, in a case where the second main body section slit 732 and the third main body section slit 733 are formed shorter and the above-described one ends 751 are positioned more to the right in the figure than the positions shown in FIG. 7A), the tip end section side of the tab 500 is hardly floated above the panel, and accordingly, the rear end section side of the tab 500 is hardly floated above the panel 400, too. Then, in this case, the user's finger is less likely to be inserted between the tab 500 and the panel 400, and thereby operability of the tab 500 is prone to be decreased.

Here, though description was omitted above, in the exemplary embodiment, since the first main body section slit 731 (refer to FIG. 8B) is provided, the load from the tab 500 (the operation load from the user) is less likely to be transmitted to the rear end section side of the rivet 900 in the state of FIG. 8B. To additionally describe, a force to pull up the rear end section side of the rivet 900 (of the rivet 900, the portion positioned closer to the first edge section 501 side of the tab 500) upward in the figure is less likely to act on the rivet 900.

Figure 8D:
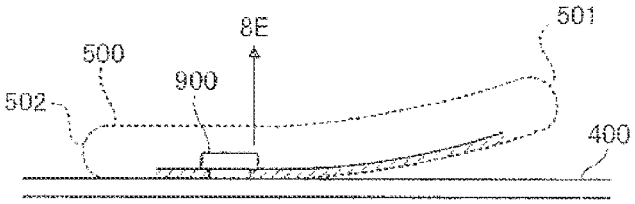

Here, if the force to pull up the rear end section side of the rivet 900 comes to act on the rivet 900, an operation force from the user begins to act more on a location distant from the second score line 450, and therefore, breakage of the panel 400 on the second score line 450 is less likely to be caused. To described further, according to FIG. 8B showing the tab in which the slit 731 is provided, when the first edge section 501 side of the tab 500 is pulled up, a force, which is indicated by 8B on the second edge section 502 side of the tab 500 in the rivet 900, comes to act on the rivet 900. On the other hand, according to FIG. 8D showing the tab, in which the slit 731 is not provided, when the tab 500 is pulled up, a force, which is indicated by 8E on the rear end section side of the rivet 900, comes to act on the rivet 900. With respect to the breakage of the panel 400 on the second score line 450, it is considered that, by applying the load 8C on the panel 400 on the side of the second edge section 502 of the tab 500 and the load 8B or 8E on the rivet 900 in mutually opposite directions, a force in the shearing direction acts on the second score line 450 formed therebetween to break thereof. At this time, as the load 8B and 8E acting on the rivet 900 are compared, with respect to each of the positions where the load is applied, 8E is a long distance from the position where the load 8C is applied, as compared with 8B. Accordingly, with respect to 8E, as compared to 8B, the force in the shearing direction applied to the second score line 450 becomes less likely to act on.

To additionally describe, by intensively applying the shearing force to the portion closer to the second score line 450, breakage of the panel 400 on the second score line 450 is able to be caused with more efficiency; however, if the load comes to act more on the rear end section side of the rivet 900, the load comes to act on a location distant from the second score line 450 (the operation load from the user is distributed), the breakage of the panel 400 on the second score line 450 is less likely to be caused.

Consequently, in the exemplary embodiment, by provision of the first main body section slit 731, the operation load from the user transmitted to the rear end section of the rivet 900. Further, by forming the one ends 751 of the second main body section slit 732 and the third main body section slit 733 between the insertion hole 540 and the second edge section 502 side of the tab 500, or the like, the operation force from the user comes to act on the tip end section side of the rivet 900 intensively (the operation load from the user comes to intensively act on a location, which is closer to the second score line 450), the breakage of the panel 400 on the second score line 450 is likely to be caused. Then, in this case, the user is able to cause the breakage of the panel 400 with less operation load.

Figure 8C:
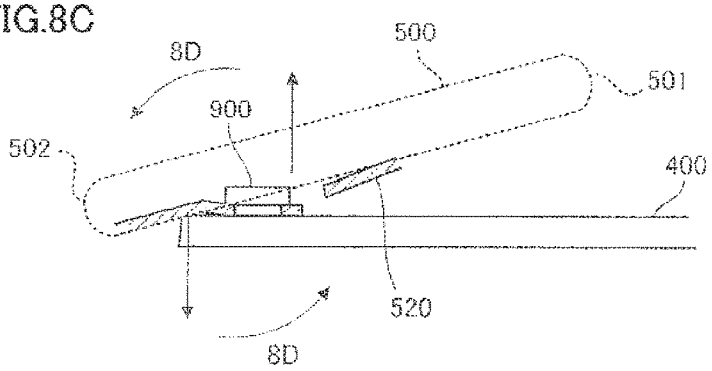

With reference to FIG. 8C, the next stage will be described.

If the rear end section of the tab 500 is further pulled up by the user from the state shown in FIG. 8B, breakage of the panel 400 is further caused, and accordingly, the panel 400 is broken to the above-described location indicated by the reference sign 4C (refer to FIG. 4) and the location indicated by the reference sign 4D, of the first score line 430.

Then, in the exemplary embodiment, by further pulling up the rear end section of the tab 500 by the user, as described above, breakage of the panel 400 further proceeds toward the basal part of the tongue section (toward the one end section 431 (refer to FIG. 4) and the other end section 432 of the first score line 430). To additionally describe, breakage of the panel 400 is caused in both of the first portion positioned between the above-described location indicated by the reference sign 4C and the one end section 431, and the second portion positioned between the above-described location indicated by the reference sign 4D and the other end section 432.

Here, FIG. 8C shows a state of the tab 500 when breakage of the panel 400 is caused in both of the above-described first portion and the above-described second portion. When breakage of the panel 400 is caused in both of the first portion and the second portion, as shown in FIG. 8C, the angle of the tab 500 with respect to the panel 400 is brought into a state of being larger, and the tip end section side of the tab 500 is brought into a state in contact with the panel 400.

Then, when the tab 500 is pulled up from the state of FIG. 8C, a force to pull the rear end section side of the rivet 900 upward comes to act on the rivet 900. To describe specifically, when the tab 500 is further pulled up from the state of FIG. 8C, the operation load from the user acts on the rear end section of the rivet 900 through the region 7C indicated by oblique lines in FIG. 7A, and thereby the rear end side of the rivet 900 is to move upward.

To describe further, according to FIG. 7A, when the first edge section 501 side of the tab 500 is gradually pulled up, the intervening section 728 starts to move in the direction apart from the panel 400. At this time, since part of the region indicated by the reference sign 7D is coupled to the intervening section 728, along with the movement of the intervening section 728, the region indicated by the reference sign 7D starts to move from the intervening section 728 in the direction gradually apart from the panel 400. The region indicated by the reference sign 7D is enclosed by the first main body section slit 731, the second main body section slit 732 and the third main body section slit 733 so as to be less susceptible to restraint from the tab main body section 520, and further, so as to be able to be dependent from the tab main body section 520 and deformable into a unique shape. Consequently, when the intervening section 728 is moved in the direction apart from the panel 400, with this, the region of the reference sign 7D is deformed while being curved so that the periphery of the first main body section slit 731 is left on the panel 400 side, and is further expanded with the intervening section 728 being regarded as a vertex section. As this state, in FIG. 8B, a situation in which the tab main body section 520 including the region 7D is separated from the panel 400 is shown. However, the above-described expansion is limited, and after the above-described expansion is stopped, the load to separate the intervening section 728 from the panel 400 comes to be transmitted to the region 7C that is connected to the region of the reference sign 7D. Since the region 7C is connected to the first edge section 501 side of the tab 500 of the insertion hole 540, into which the rivet 900 is fitted, part of the operation force from the user becomes a force to pull up the rear end section side of the rivet 900, which is the right side of the rivet 900 shown in FIG. 8C. Moreover, the force becomes a force to pull up the panel 400 on the right side of the rivet 900. On the other hand, on the panel 400 on the left side of the rivet 900, a force to press down the panel 400 by the tip end of the tab 500 is acting.

As a result, in the exemplary embodiment, the rotational moment indicated by arrow 8D (refer to FIG. 8C) comes to act on the panel 400, and by the rotational moment, the tongue section enters into the inside of the beverage can 100. To additionally describe, breakage of the panel 400 is caused in both of the above-described first portion positioned between the above-described location indicated by the reference sign 4C (refer to FIG. 4) and the one end section 431, and the above-described second portion positioned between the above-described location indicated by the reference sign 4D and the other end section 432, and the tongue section enters into the inside of the beverage can 100.

Here, to recapitulate the load applied to the rivet 900, the load 8B shown in FIG. 8B is mainly a load applied to the tip end section side of the rivet 900 in the course of opening formation in the regions 4A and 4B in FIG. 4. When the opening in the regions 4A and 4B in FIG. 4 is formed, the above-described expansion of the reference sign 7D is stopped, and thereby the tab 500 is brought into a state of being pulled up to have a predetermined inclination. Thereafter, when the tab 500 is further pulled up, the load is mainly applied to the rear end section side of the rivet 900 through the region of the reference sign 7D and the region 7C. In this manner, the rotational moment 8D shown in FIG. 8C comes to act.

It should be noted that, in the exemplary embodiment, the operation load from the user is transmitted to the rear end section of the rivet 900 by use of the intervening section 728 (refer to FIG. 7A). Here, in a case where the intervening section 728 is not provided, to additionally describe, in a case where the second main body section slit 732 and the third main body section slit 733 are connected, the tab 500 is to rotate around a straight line (refer to the straight line indicated by the reference sign 7E in FIG. 7A) that passes through the one end 751 (refer to FIG. 7A) of the second main body section slit 732 and the one end 751 of the third main body section slit 733. In such a case, the load applied to the rear end section of the rivet 900 is reduced, and thereby the rotational moment that acts on the above-described tongue section is decreased.

Here, in the exemplary embodiment, as described above, in an initial stage of operation of the tab 500 by the user, more load acts on the tip end section side of the rivet 900. Consequently, the load intensively acts on the second score line 450, and accordingly, breakage of the panel 400 on the second score line 450 is more likely to be caused. Then, in the exemplary embodiment, by further pulling up the tab 500, the load that acts on the rear end section of the rivet 900 is increased, and accordingly, bending moment acts on the above-described tongue section. This allows the tongue section to enter into the inside of the beverage can 100, and thereby the opening in the beverage can 100 becomes larger.

It should be noted that, in the exemplary embodiment, the other ends 752 of the second main body section slit 731 and the third main body section slit 733 are positioned between the first main body section slit 731 and the first edge section 501 of the tab 500 to head for the center line CL of the tab 500. Consequently, in the exemplary embodiment, there is provided a configuration in which the second main body section slit 732 and the third main body section slit 733 extend between the first main body section slit 731 and the first edge section 501 of the tab 500 to a region heading for the center line CL of the tab 500 from the above-described one ends 751 as the starting points.

In the case of such a configuration, as compared to a case in which the second main body section slit 732 and the third main body section slit 733 do not extend to an area between the first main body section slit 731 and the first edge section 501, it becomes possible to reduce the load to lift the rear end section of the rivet 900. More specifically, it becomes possible to reduce the load applied to the rear end section side of the rivet 900 when the operation of the tab 500 is started. To describe further, it becomes possible to reduce the load applied to the rear end section side of the rivet 900 when breakage of the panel 400 on the second score line 450 is caused. Then, in this case, as described above, it becomes possible to make the load intensively act on the second score line 450.

Here, in the exemplary embodiment, as described above, the operation load from the user acts on the rear end section of the rivet 900 through the portion of the region 7C indicated by oblique lines in FIG. 7A. Here, as in the exemplary embodiment, in the case where the second main body section slit 732 and the third main body section slit 733 extend between the first main body section slit 731 and the first edge section 501 of the tab 500 to head for the center line CL of the tab 500, there is provided a state in which the first main body section slit 731 is positioned between the intervening section 728 that transmits the load from the rear end section side of the tab 500 to the tip end section side of the tab 500 and the rivet 900.

To additionally describe, in the case where the second main body section slit 732 and the third main body section slit 733 extend between the first main body section slit 731 and the first edge section 501 of the tab 500 to head for the center line CL of the tab 500, there is provided a state in which the first main body section slit 731 that makes the load to the rear end side of the rivet 900 less likely to be transmitted is positioned between the intervening section 728 and the rivet 900. Then, in this case, the load applied to the rear end side of the rivet 900 when the operation of the tab 500 is started by the user is reduced. Then, in this case, as described above, the load intensively acts on the second score line 450.

To check the process of opening formation in the panel 400 in the exemplary embodiment anew, first, by pulling up the rear end section of the tab 500 by the user, the tab 500 becomes inclined with respect to the panel 400, and thereby a gap is formed between the rear end section of the tab 500 and the panel 400. Refer to FIG. 8B.

This is because, by the region 7D formed by the second main body section slit 732 and the third main body section slit 733, the stiffness of the tab main body section 520 on the rear end section side of the rivet 900 as shown in FIG. 8D is decreased, and the one ends 751 of the second main body section slit 732 and the third main body section slit 733 shown in FIG. 7A extend between the insertion hole 540 and the second edge section 502 side to form the region 7A, to thereby make it possible for the region 7A to be bent so that the vicinity of 8A shown in FIG. 8B is separated from the panel 400.

By the above-described gap, it is easy for the user to insert a finger. By pulling up the rear end section of the tab 500 by the inserted finger, the tip end section of the tab 500 presses the panel 400 to start breakage of the panel 400. Thereafter, breakage of the panel 400 is further caused, and accordingly, the panel 400 is broken to the location of the first score line 430 indicated by the reference sign 4C (refer to FIG. 4) and the location of the first score line 430 indicated by the reference sign 4D. At this time, in the rivet 900, the load from the tab 500 (the operation load from the user) acts on the tip end section side of the rivet 900.

In a case where the region of the reference sign 7D is observed in FIG. 7A, when the tab 500 is pulled up, the intervening section 728 connected to the tab main body section 520 is lifted. To put another way, by pulling up the tab 500, the region of the reference sign 7D is lifted from the intervening section 728 side. In the region of reference sign 7D at this time, since the intervening section 728, which is one end section, is lifted while both end sections side of the first main body section slit 731, which is the other end section, is left on the panel 400 side, the region of the reference sign 7D expands with curvature deformation while the intervening section 728 being regarded as a vertex section. At this point of time, due to the above-described expansion, the load from the tab 500 is less likely to act on the rear end section side of the rivet 900.

On the other hand, as indicated by 8B in FIG. 8B, the load from the tab 500 acts on the tip end section side of the rivet 900 as a reactive force of the press of the panel 400 by the tip end of the tab 500. Thereafter, breakage of the panel 400 further proceeds, and thereby, the panel 400 is broken to the above-described location of the first score line 430 indicated by the reference sign 4C (refer to FIG. 4) and the location of the first score line 430 indicated by the reference sign 4D. During the course until now, mainly, the load from the tab 500 acts on the tip end section side of the rivet 900, and thereby breakage of the panel 400 proceeds. On the other hand, due to expansion of the above-described region of the reference sign 7D, the load from the tab 500 is less likely to act on the rear end section side of the rivet 900.

However, since the expansion of the region of the reference sign 7D is limited because of being associated with the curvature deformation, after expansion of a predetermined amount, the region 7D is hardly expanded further, and therefore, the load from the tab 500 is transmitted to the region 7C by way of the region of the reference sign 7D, to thereby act on the rear end section side of the rivet 900. To describe further, the load from the tab 500 mainly acts on the tip end section side of the rivet 900 in substantially the first half of the opening process, and also acts on the rear end section side of the rivet 900 in substantially the second half. As the panel 400 around the rivet 900 in the above-described second half is observed, since the tip end of the tab 500 continues to press the panel 400 of the tip end section side of the rivet 900, as shown in FIG. 8C, rotational moment 8D comes to act on the panel 400 around the rivet 900. The rotational moment 8D breaks the score that leads to the region of the one end section 431 from the reference sign 4C shown in FIG. 4 and that leads to the other end section 432 from the reference sign 4D and acts to bend the region enclosed by the above-described score and insert thereof into the can, to thereby form the opening in the panel 400.

Figure 9A:
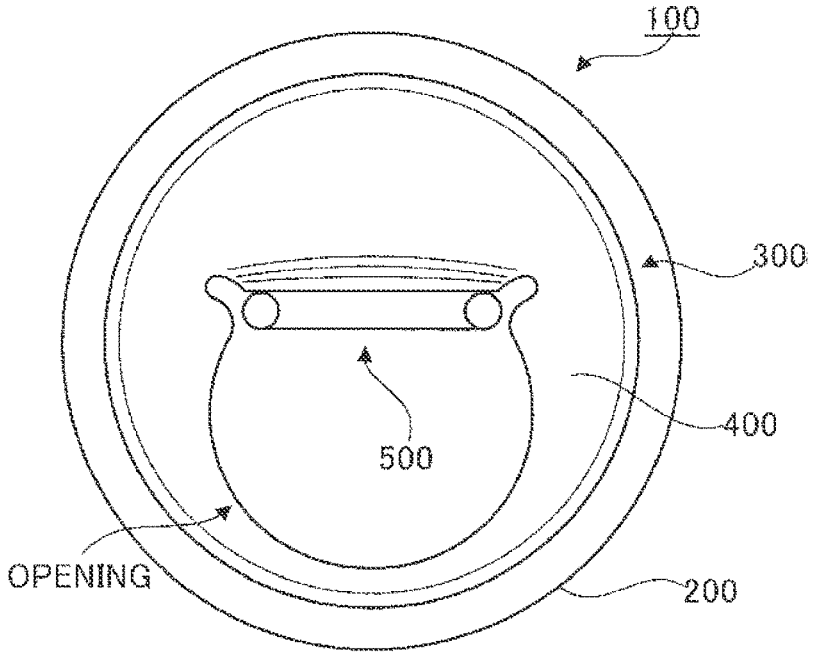
FIGS. 9A and 9B are diagrams in a case where the beverage can is viewed from above.
Figure 9B:
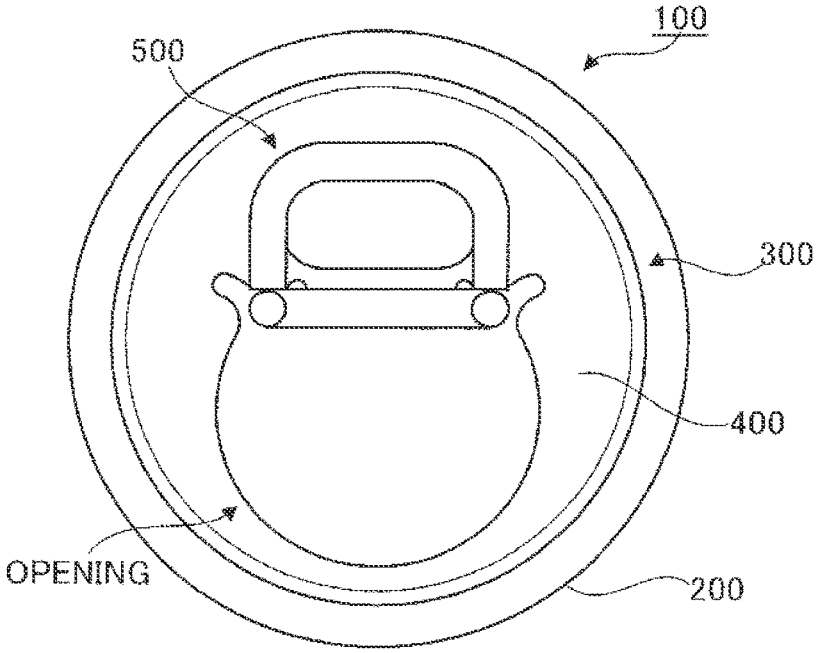

It should be noted that, though the description was omitted above, when the tongue section enters into the inside of the beverage can 100, as shown in FIG. 9A (FIGS. 9A and 9B are diagrams in a case where the beverage can 100 is viewed from above), the tip end section side of the tab 500 enters into the inside of the beverage can 100. It should be noted that FIG. 9A shows a state in which the tab 500 stands up and the panel 400 and the tab 500 are orthogonal. Thereafter, the pulled-up tab 500 is to be returned to the original state by the user, and on this occasion, bending of the tab 500 is caused at the first curling section slit 521 (refer to FIGS. 7A to 7D), the second curling section slit 522 and the groove 523, which have been described above.

As a result, in the exemplary embodiment, as shown in FIG. 9B, the rear end section side of the tab 500 lies along the panel 400. On the other hand, the tip end section side of the tab 500 is in a state of entering into the inside of the beverage can 100. Here, when the pulled-up tab 500 is to be returned to the original state by the user, if bending of the tab 500 is not caused, part of the opening having been formed is blocked by the tip end section side of the tab 500. In the case of exemplary embodiment, the tip end section side stays inside of the beverage can 100, and thereby overlapping of the opening and the tab 500 becomes small.

Figure 10:
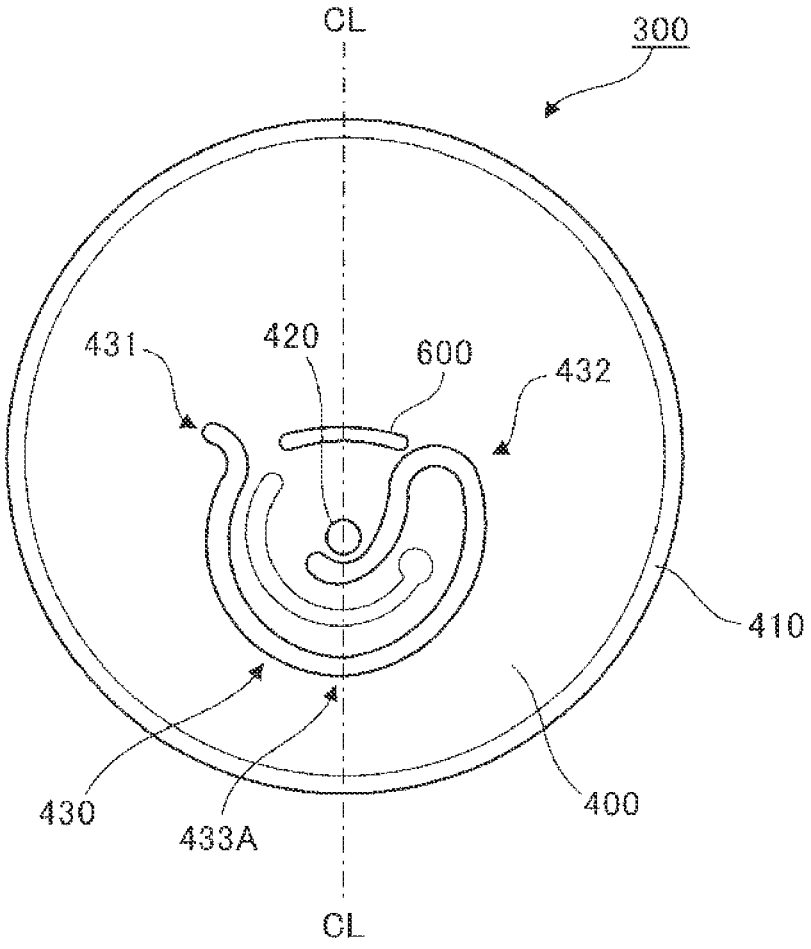
FIG. 10 is a diagram showing another configuration example of a can lid.

It should be noted that, though the mode in which the second score line 450 is provided on the panel 400 was described above, a mode in which the second score line 450 is omitted is available. Specifically, for example, as shown in FIG. 10 (a diagram showing another configuration example of the can lid 300), there can be a configuration in which one end section of the first score line 430 is extended, and the extended portion of the first score line 430 passes between the protruding section 420 and the vertex section 433A.

REFERENCE SIGNS LIST

100 . . . Beverage can
200 . . . Container main body (can barrel)
300 . . . Can lid
400 . . . Panel
410 . . . Outer peripheral edge
500 . . . Tab
501 . . . First edge section
502 . . . Second edge section
731 . . . First main body section slit
732 . . . Second main body section slit
733 . . . Third main body section slit
751 . . . One end
900 . . . Rivet

The invention claimed is:

1. A can lid comprising:

a panel that includes an outer peripheral edge and is attached to an aperture of a can barrel;

a tab that includes a first edge section, a second edge section on a side opposite to the first edge section, a first side edge formed to head for the second edge section from the first edge section, and a second side edge formed to head for the second edge section from the first edge section and arranged on a side opposite to the first side edge, the tab being operated by a user, when an opening is formed in the panel, to move in a direction in which a first edge section side is apart from the panel; and a connecting section that connects a portion of the tab positioned between the first edge section and the second edge section and the panel, wherein the tab is provided with:

a first through hole that is provided between the first edge section and the connecting section;

a second through hole that is formed to include one end section closer to a side, on which the second edge section is provided, than the connecting section, and is formed to pass between the connecting section and the first side edge and also between the first through hole and the first side edge to head for the first edge section side from a location where the one end section is positioned, the second through hole being formed so that at least a part thereof heads for a second side edge side and an other end section is located in a region positioned between the first through hole and the first edge section; and a third through hole that is formed to include one end section closer to a side, on which the second edge section is provided, than the connecting section, and is formed to pass between the connecting section and the second side edge and also between the first through hole and the second side edge to head for the first edge section side from a location where the one end section is positioned, the third through hole being formed so that at least a part thereof heads for a first side edge side and the other end section is positioned in the region located between the first through hole and the first edge section, and wherein the tab is further provided with an insertion hole for connecting the tab to the panel, the first through hole is provided on a side closer to the insertion hole than the second through hole, and the first through hole is provided on a side closer to the insertion hole than the third through hole.

2. The can lid according to claim 1, wherein the connecting section connects a portion positioned on a center line of the tab and the panel, the portion being positioned on the center line heading for the second edge section side from the first edge section side, the first through hole is provided on the center line of the tab, and formed into a linear symmetrical shape with respect to the center line as a symmetrical axis, and one through hole of the second through hole and the third through hole is formed in one of two regions facing with the center line interposed therebetween, and the other through hole is formed on the other of the two regions, the second through hole and the third through hole being arranged in a linear symmetrical relation with respect to the center line as a symmetrical axis.

3. The can lid according to claim 1, wherein the first through hole is formed to draw a circular arc around a location where the connecting section is provided.

4. The can lid according to claim 3, wherein the second through hole and the third through hole are formed to draw circular arcs around the location where the connecting section is provided.

5. The can lid according to claim 4, wherein the second through hole and the third through hole, which are formed to draw the circular arcs, are provided to pass through a location which is separated from the connecting section by a first separation distance, and are formed so that the first separation distance is larger than a separation distance between the first through hole and the connecting section, the second through hole and the third through hole extending to the region positioned between the first through hole and the first edge section.

6. A beverage can comprising:

a can barrel that includes an aperture and contains a beverage inside thereof; and a can lid with which the aperture of the can barrel is covered, wherein the can lid includes:

a panel that includes an outer peripheral edge and is attached to the aperture of the can barrel;

a tab that includes a first edge section, a second edge section on a side opposite to the first edge section, a first side edge formed to head for the second edge section from the first edge section, and a second side edge formed to head for the second edge section from the first edge section and arranged on a side opposite to the first side edge, the tab being operated by a user, when an opening is formed in the panel, to move in a direction in which a first edge section side is apart from the panel; and a connecting section that connects a portion of the tab positioned between the first edge section and the second edge section and the panel, wherein the tab is provided with:

a first through hole that is provided between the first edge section and the connecting section;

a second through hole that is formed to include one end section closer to a side, on which the second edge section is provided, than the connecting section, and is formed to pass between the connecting section and the first side edge and also between the first through hole and the first side edge to head for the first edge section side from a location where the one end section is positioned, the second through hole being formed so that at least a part thereof heads for a second side edge side and an other end section is located in a region positioned between the first through hole and the first edge section; and a third through hole that is formed to include one end section closer to a side, on which the second edge section is provided, than the connecting section, and is formed to pass between the connecting section and the second side edge and also between the first through hole and the second side edge to head for the first edge section side from a location where the one end section is positioned, the third through hole being formed so that at least a part thereof heads for a first side edge side and the other end section is positioned in the region located between the first through hole and the first edge section, and wherein the tab is further provided with an insertion hole for connecting the tab to the panel, the first through hole is provided on a side closer to the insertion hole than the second through hole, and the first through hole is provided on a side closer to the insertion hole than the third through hole.

* * * * *